US011654341B2

(12) United States Patent
Huang et al.

(10) Patent No.: US 11,654,341 B2
(45) Date of Patent: May 23, 2023

(54) ATTACHMENT STRUCTURE FOR A SWIMMING MACHINE

(71) Applicant: Intex Marketing Ltd., Tortola (VG)

(72) Inventors: Zhi Xiong Huang, Fujian (CN); Ying Biao Zhang, Fujian (CN); Zheng Wen Lin, Fujian (CN)

(73) Assignee: Intex Marketing Ltd., Tortola (VG)

( * ) Notice: Subject to any disclaimer, the term of this patent is extended or adjusted under 35 U.S.C. 154(b) by 156 days.

(21) Appl. No.: 17/085,202

(22) Filed: Oct. 30, 2020

(65) Prior Publication Data

US 2021/0129002 A1 May 6, 2021

(51) Int. Cl.
*A63B 69/12* (2006.01)
*E04H 4/12* (2006.01)

(52) U.S. Cl.
CPC ..... *A63B 69/125* (2013.01); *E04H 4/12* (2013.01)

(58) Field of Classification Search
CPC ..... A63B 69/125; E04H 4/04; E04H 4/12
USPC ..... 4/488, 492, 496
See application file for complete search history.

(56) References Cited

U.S. PATENT DOCUMENTS 1,630,797 A 5/1927 Marwick
3,476,106 A 11/1969 Ritz et al.
3,534,413 A 10/1970 Plasseraud
3,820,173 A * 6/1974 Weller ..... E04H 4/1245 4/496
4,115,878 A 9/1978 Johnson et al.
4,352,215 A 10/1982 Laing
4,375,337 A 3/1983 Yerger
4,379,438 A 4/1983 Peardon
4,420,846 A 12/1983 Bonner
4,502,168 A 3/1985 Jaworski
4,523,340 A 6/1985 Watkins
4,525,881 A 7/1985 Higginbotham
4,561,133 A 12/1985 Laing
4,665,572 A 5/1987 Davidson et al.
4,731,887 A 3/1988 Henkin et al.
4,763,366 A 8/1988 Moreland
4,773,104 A 9/1988 Wang
4,780,917 A 11/1988 Hancock
4,801,378 A 1/1989 Desjoyaux et al.
(Continued)

FOREIGN PATENT DOCUMENTS

CH 707912 * 10/2014 ..... A63B 69/125
DE 3408217 A1 9/1985
(Continued)

OTHER PUBLICATIONS

Endless Pools, "Fastlane Pool: Cost effective and easy to install for a quality swim, year-round," available at http://www.endlesspools.com/fastlane-pool.php at least as early as Dec. 18, 2014, 1 page.

*Primary Examiner* — John E Simms, Jr.
(74) *Attorney, Agent, or Firm* — Faegre Drinker Biddle & Reath LLP

(57) ABSTRACT

An adjustable attachment structure for a swimming machine is disclosed. The attachment structure is configured to interact with a frame of a pool. A user may interact with a locking switch to transition the attachment structure between a locked and an unlocked state. In the unlocked state, the swimming machine may be rotated about an axis to direct a generated current in a number of directions.

26 Claims, 14 Drawing Sheets

(56) References Cited

U.S. PATENT DOCUMENTS 4,843,659 A 7/1989 Popovich et al.
4,845,787 A 7/1989 Lior
4,853,987 A 8/1989 Jaworski
4,903,352 A 2/1990 Murakami
4,907,304 A 3/1990 Davidson et al.
4,920,588 A 5/1990 Watkins
5,005,228 A 4/1991 Mermelstein
5,044,021 A 9/1991 Murdock
5,095,558 A 3/1992 Howard
5,167,041 A 12/1992 Burkitt, III
5,172,754 A 12/1992 Graber et al.
5,226,408 A 7/1993 Drysdale
5,291,621 A 3/1994 Mathis
5,298,003 A * 3/1994 Weihe ..... A63B 69/125 4/492
5,379,467 A 1/1995 Lochbaum
5,408,708 A 4/1995 Mathis
5,495,627 A 3/1996 Leaverton et al.
5,570,481 A 11/1996 Mathis et al.
5,597,288 A 1/1997 Hatanaka
5,662,557 A 9/1997 Watterson et al.
5,662,558 A * 9/1997 Shannon, III ..... E04H 4/0006 4/491
5,758,369 A 6/1998 Takahashi et al.
5,862,543 A 1/1999 Reynoso et al.
5,915,849 A 6/1999 Dongo
5,920,925 A 7/1999 Dongo
5,983,416 A * 11/1999 Idland ..... A61H 33/6052 4/492
6,000,073 A 12/1999 Eddington
6,009,574 A 1/2000 Moreland
6,030,180 A 2/2000 Clarey et al.
6,065,161 A 5/2000 Mateina et al.
6,123,274 A 9/2000 Perdreau et al.
6,165,358 A 12/2000 Denkewicz et al.
6,233,754 B1 5/2001 Ajima
6,263,522 B1 7/2001 Dongo et al.
6,454,523 B1 9/2002 Loyd et al.
6,578,207 B1 6/2003 Fratilla
6,592,341 B1 7/2003 Olney
6,675,404 B2 1/2004 Brennan et al.
6,688,845 B2 2/2004 Pages Pages
6,692,645 B1 2/2004 Gargas
6,789,278 B2 9/2004 Shea
6,797,164 B2 9/2004 Leaverton
6,857,967 B2 2/2005 Loyd et al.
6,859,953 B1 3/2005 Christensen
6,968,581 B2 11/2005 Christensen
7,001,159 B2 2/2006 Peterson et al.
7,067,056 B2 6/2006 Collins
7,252,761 B2 8/2007 Lamberts Van Assche
7,493,665 B2 2/2009 Williams
7,526,820 B2 5/2009 Murdock et al.
7,531,092 B2 5/2009 Hazlehurst
7,676,977 B1 * 3/2010 Cahill ..... F16M 11/16 248/168
7,712,161 B2 5/2010 Reynolds, II
7,818,826 B2 10/2010 Schmidt et al.
7,984,519 B1 7/2011 Hall
8,011,032 B2 9/2011 Cline et al.
8,104,110 B2 1/2012 Caudill et al.
8,141,180 B2 3/2012 Hof
8,186,517 B2 5/2012 Bowman et al.
8,214,936 B2 7/2012 Thweatt, Jr.
8,453,275 B2 6/2013 May et al.
8,607,372 B2 12/2013 Hall
8,689,370 B2 4/2014 Fleischer
8,702,387 B2 4/2014 Gillette
8,739,322 B2 6/2014 Hof
8,907,616 B2 12/2014 Liu et al.
9,599,429 B1 * 3/2017 Davis ..... F41C 23/16
9,979,182 B2 * 5/2018 Lin ..... H01M 10/46
10,193,329 B2 1/2019 Lin et al.
11,198,049 B2 12/2021 Huang et al.
2003/0200604 A1 10/2003 Loyd et al.
2003/0218812 A1 * 11/2003 Foote ..... B60R 1/074 359/874
2004/0040908 A1 3/2004 Orava et al.
2004/0148693 A1 8/2004 Anderson
2006/0021129 A1 2/2006 Williams et al.
2006/0124535 A1 6/2006 Harbol
2006/0137087 A1 6/2006 Carreau et al.
2006/0226060 A1 10/2006 Mercer
2006/0282943 A1 12/2006 Vandecamp
2007/0039876 A1 2/2007 Gori
2007/0094784 A1 5/2007 Tran
2007/0214560 A1 9/2007 Chivers et al.
2008/0016610 A1 1/2008 Kuo et al.
2008/0086810 A1 4/2008 Le
2008/0148470 A1 6/2008 Ferriss et al.
2009/0100589 A1 4/2009 Peterson et al.
2009/0133766 A1 5/2009 Elnar
2009/0158518 A1 6/2009 Southon et al.
2010/0058528 A1 3/2010 Clarey
2010/0064428 A1 3/2010 Loyd et al.
2010/0269251 A1 10/2010 Demotts
2011/0004993 A1 1/2011 Frei
2011/0247970 A1 10/2011 Evingham
2011/0253638 A1 10/2011 Easland et al.
2012/0090087 A1 4/2012 Korupp et al.
2012/0117724 A1 5/2012 Caudill et al.
2013/0031711 A1 2/2013 Walsh et al.
2013/0034430 A1 2/2013 Braswell
2013/0145539 A1 6/2013 Cooke
2013/0283563 A1 * 10/2013 Fry ..... B01D 46/76 55/304
2013/0334113 A1 12/2013 Erlich
2014/0047632 A1 2/2014 Hall
2014/0101840 A1 4/2014 Harder
2014/0331398 A1 11/2014 Walsh et al.
2015/0295397 A1 * 10/2015 Lin ..... E04H 4/0006 4/491
2018/0372235 A1 * 12/2018 Smith ..... F16K 11/0853
2019/0373349 A1 * 12/2019 Carrasca ..... F16M 11/04
2020/0016471 A1 * 1/2020 Huang ..... E04H 4/12
2020/0269114 A1 * 8/2020 Huang ..... E04H 4/14

FOREIGN PATENT DOCUMENTS

EP 0614684 A1 9/1994
WO 2014/071536 A1 5/2014

* cited by examiner

ATTACHMENT STRUCTURE FOR A SWIMMING MACHINE

FIELD OF THE DISCLOSURE

The present disclosure relates to a swimming machine for use in a swimming pool. More specifically, the present disclosure relates to an adjustable attachment structure for a swimming machine for use in a swimming pool.

BACKGROUND OF THE DISCLOSURE

Current generators or swimming machines for swimming pools are often used to push water within a pool to generate a current or a directional flow in what would otherwise be a relatively stationary body of water. Users can swim or walk against the current to simulate exercising or moving in a larger body of water. Users can also relax and float with the current. However, many of these devices are integral parts of the pool or its surrounding structure and cannot be used within multiple different types of pools. Additionally, many of these systems are not adjustable to allow for directing the flow or current in various directions.

SUMMARY

An adjustable attachment structure for a swimming machine is disclosed. The attachment structure is configured to interact with a frame of a pool. A user may interact with a locking switch to transition the attachment structure between a locked and an unlocked state. In the unlocked state, the swimming machine may be rotated about an axis to direct a generated current in a number of directions.

According to an embodiment of the present disclosure, a swimming machine assembly is disclosed having a main body configured to generate a current in a pool, an attachment assembly configured to couple to the main body, the attachment assembly having an assembly hub, a connector configured to couple the main body to the assembly hub, a rotary positioning member positioned within the assembly hub and configured to position the main body in a number of rotational positions, a locking switch coupled to the assembly hub and configured to move the rotary positioning member between an unlocked state and a locked state, wherein in the unlocked state the main body is movable between the number of rotational positions, and the swimming machine assembly also includes a mounting structure coupled to the main body through the attachment assembly and configured to be mounted to a pool.

According to another embodiment of the present disclosure, a mount for a swimming machine is disclosed, the mount having a mounting structure configured to removably mount to a frame of a pool, an attachment assembly coupled to the mounting structure and to the swimming machine, the attachment assembly comprising an assembly hub fixedly coupled to the mounting structure, and a rotary positioning member coupled to the swimming machine, positioned within the assembly hub, and rotatable relative to the assembly hub, wherein the swimming machine and the rotary positioning member rotate together around an axis.

According to yet another embodiment of the present disclosure, a method of positioning a swimming machine within a pool is disclosed, the method having the steps of coupling the swimming machine to an attachment assembly, mounting a mounting structure on the pool, coupling the attachment assembly to the mounting structure through a plurality of fasteners, unlocking a rotary positioning member within the attachment assembly, rotating the swimming machine along an axis to angle the swimming machine relative to a wall of the pool, and locking the rotary positioning member to limit rotation of the swimming machine relative to the wall of the pool.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
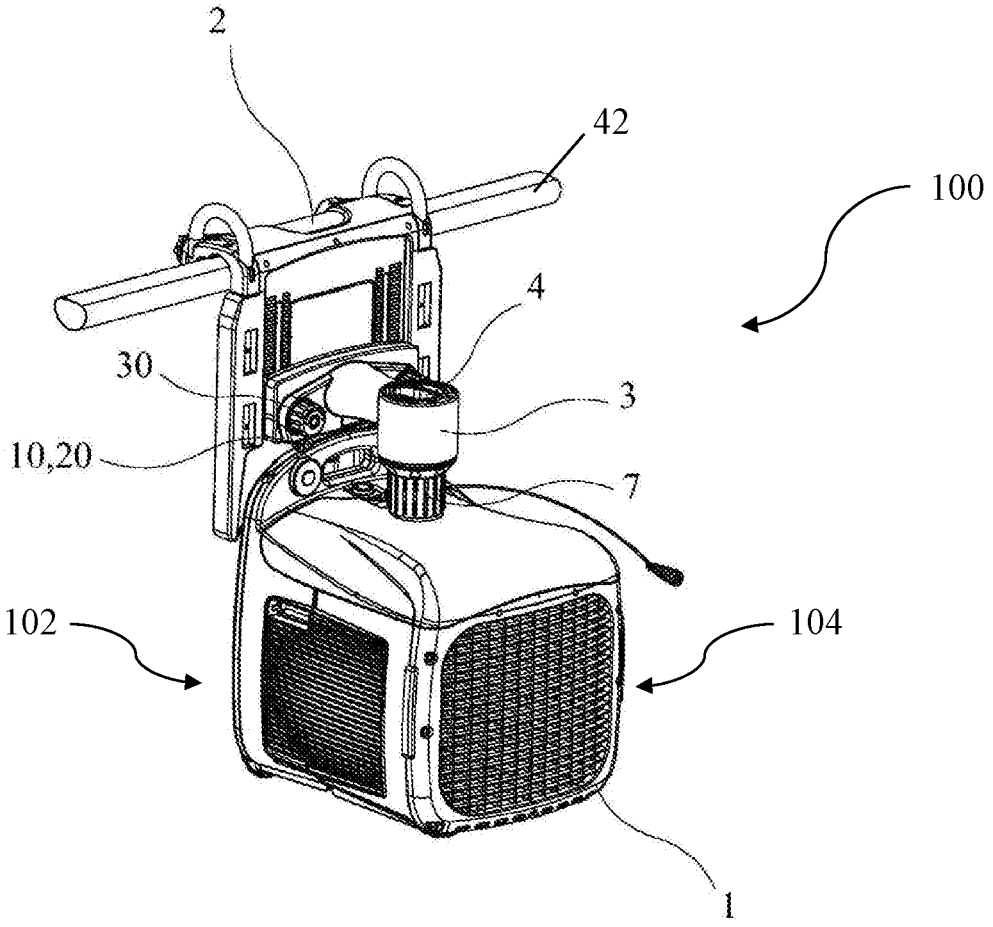
FIG. 1 is a perspective view of an exemplary swimming machine of the present disclosure.

According to the present disclosure, a swimming machine 100 is provided. The swimming machine 100 is configured to generate a current or a directional flow of water within a pool 200 (See FIGS. 12-14). The illustrative pool 200 is an above-ground frame pool having a liner 40 suspended from and supported by a frame 42 (See FIG. 7), the liner 40 forming a sidewall 44 and a floor 46 to contain the water in the pool 200. It is also within the scope of the present disclosure for the pool 200 to be an above-ground pool or an in-ground pool, for example. The swimming machine 100 may be at least partially submerged in the water of the pool 200. During operation, a motor-driven impeller (not shown) inside the swimming machine 100 may draw water into an inlet side 102 of the swimming machine 100 and direct water from the outlet side 104 of the swimming machine 100 in a flow direction F, thereby generating the current or directional flow of water. Additional information regarding the operation of swimming machine 100 is described below with respect to FIGS. 12-14 and in U.S. Pat. No. 10,193,329, titled "Wave Making Mechanism", the entire disclosure of which is incorporated herein by reference.

Figure 2:
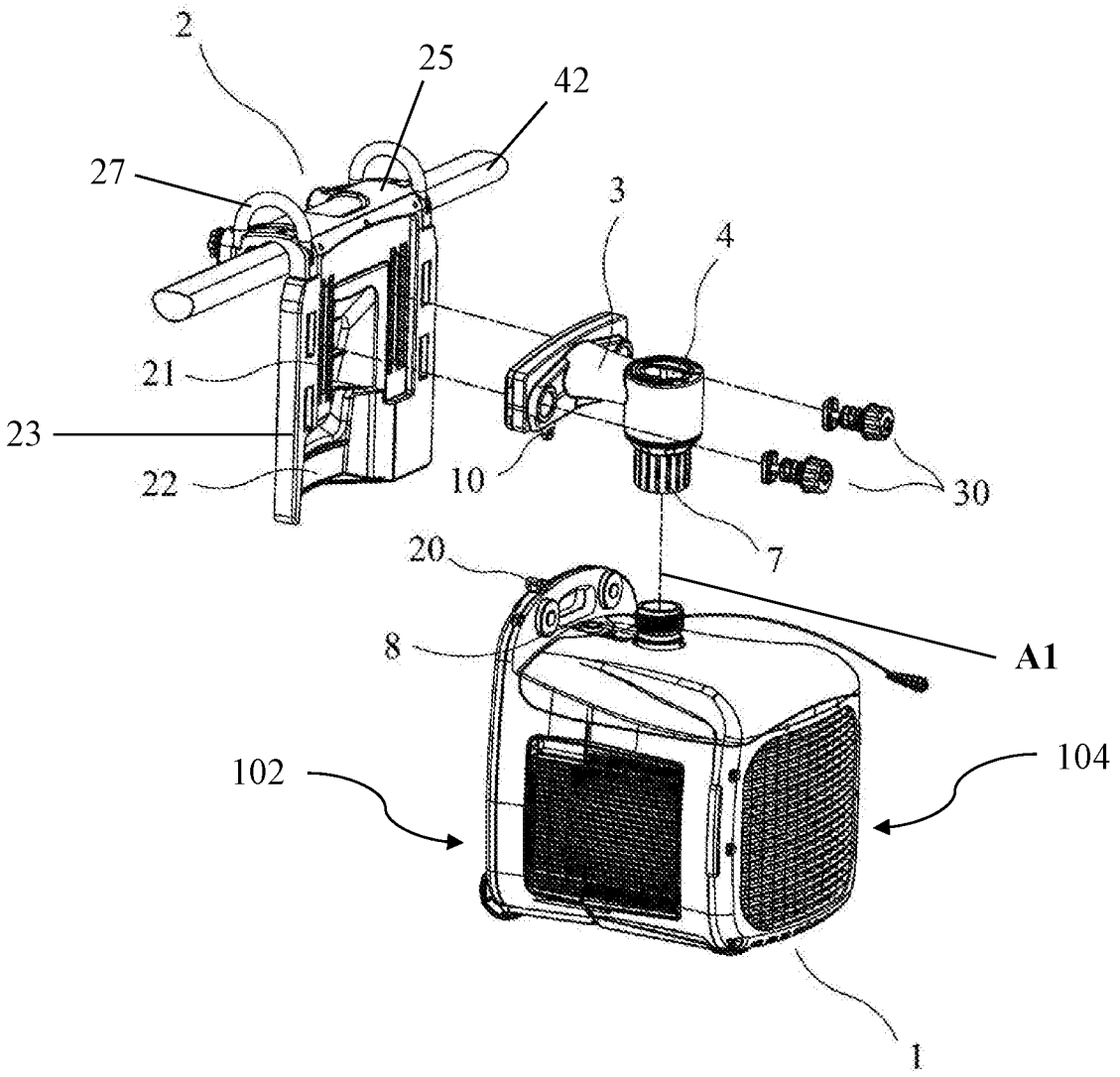
FIG. 2 is an exploded view of the swimming machine of FIG. 1.

Referring to FIGS. 1-2, the swimming machine 100 comprises a main body 1 that houses the motor-driven impeller (not shown), an attachment assembly 3, and a mounting structure 2. Mounting structure 2 is configured to interact with frame 42 of a pool 200 (See FIG. 7) in order to attach or mount swimming machine 100 to the pool 200. The attachment assembly 3 is configured to couple the main body 1 to the mounting structure 2 through fasteners 30, and to provide a user with the ability to adjust the swimming machine 100, as will be described in more detail herein.

The attachment assembly 3 is coupled to main body 1 through an attachment connector 7. The attachment connector 7 is configured to couple with an attachment mount 8 on the main body 1. In the illustrated embodiment, attachment connector 7 comprises an interior threading, and attachment mount 8 comprises an exterior threading such that attachment connector 7 may couple to attachment mount 8 through a nut and screw type assembly, where attachment connector 7 is a nut and attachment mount 8 is a screw. In other embodiments, attachment connector 7 and attachment mount 8 may couple through other coupling mechanisms, including flexible snaps, protrusions and recessions, rivets, snap buttons, friction couplings, or adhesives. The main body 1 is further coupled to the attachment assembly 3 through a slidable connector 10 and a fixed connector 20 on main body 1. The slidable connector 10 is slidably coupled to attachment assembly 3 through a groove 34 (See FIG. 3) and is configured to couple with the fixed connector 20 on main body 1. In the illustrated embodiment, groove 34 extends along an arc of a circle with a center approximately along a central axis A1 of attachment connector 7. The shape of groove 34 allows for the slidable connector 10 to slide within the groove 34 when swimming machine 100 is rotated around the axis A1, as described further below. In other embodiments, groove 34 may be shaped differently to accommodate different ranges and directions of motion. For example, groove 34 may be straight to allow for sliding of main body 1 in a linear direction. Slidable connector 10 is configured to couple with fixed connector 20 using a pin (not shown) or another suitable connector, which provides another point of coupling between attachment assembly 3 and main body 1, providing additional stability to swimming machine 100 when fully assembled and controlling the path and range of motion of main body 1 relative to attachment assembly 3. The rotation of main body 1 relative to mounting structure 2 (and pool 200) about axis A1 is described further below and may constitute a first degree of freedom.

Figure 3:
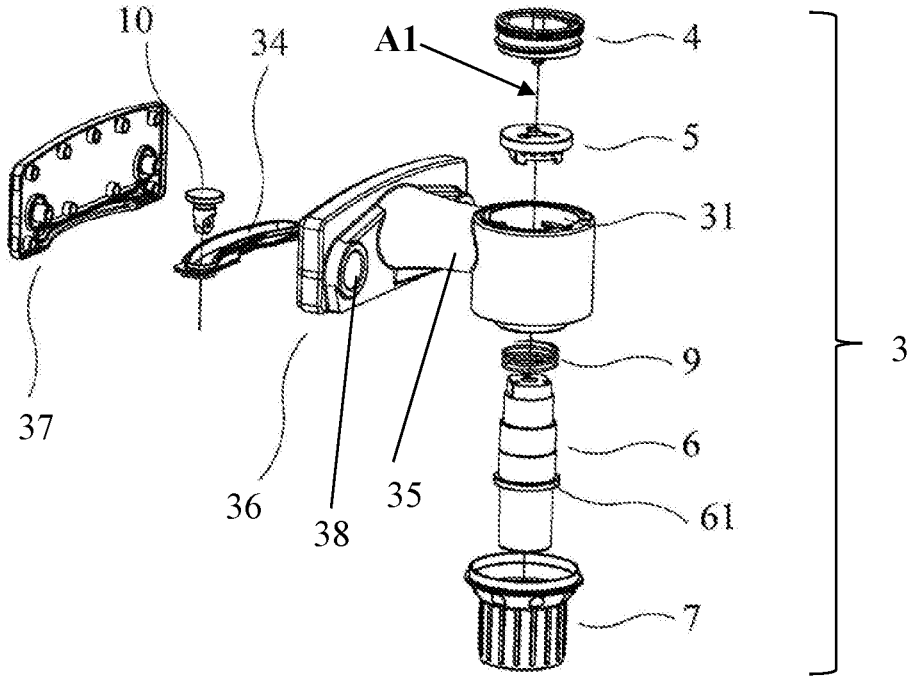
FIG. 3 is an exploded view of an attachment assembly of the swimming machine of FIG. 1.
Figure 4:
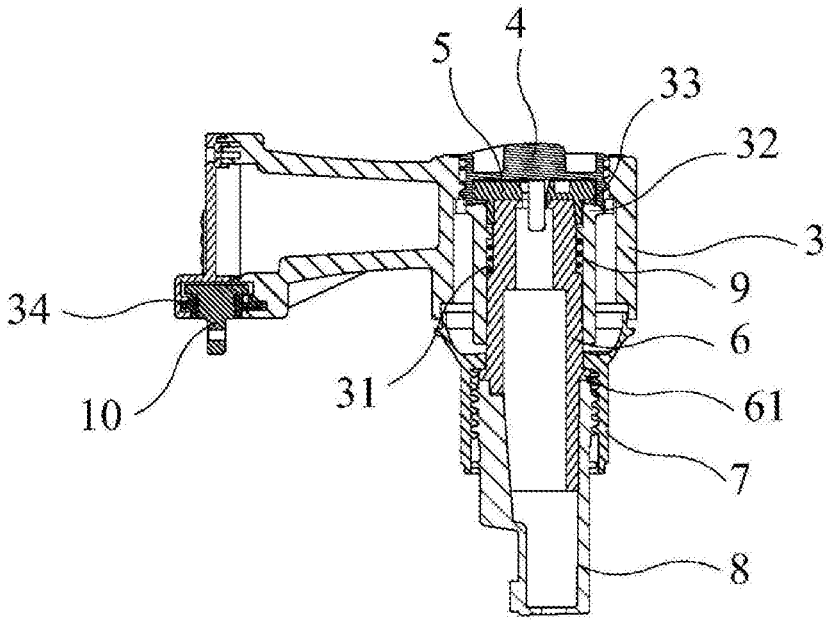
FIG. 4 is a cross-sectional view of the attachment assembly of FIG. 3.
Figure 5:
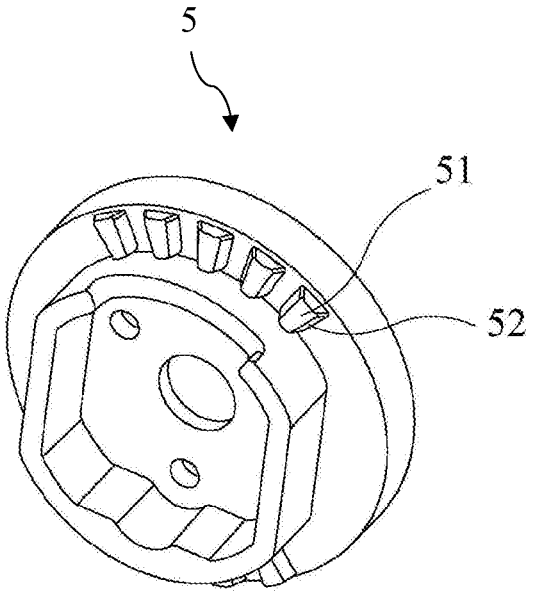
FIG. 5 is a perspective view of a rotary positioning member of the attachment assembly of FIG. 3.

Referring now to FIGS. 3-5, attachment assembly 3 additionally comprises an assembly hub 35, a front bracket 36, a rear bracket 37, a support shaft 6 with a flange 61, a spring 9, a pivot bore 31, a rotary positioning member 5, and a locking switch 4. When attachment connector 7 is coupled to attachment mount 8 on main body 1, the flange 61 of support shaft 6 becomes clamped between attachment connector 7 and attachment mount 8, thereby fixing each of the three components relative to one another. The support shaft 6 extends upward through pivot bore 31 and is coupled at its top to rotary positioning member 5 in a keyed or rotationally locked manner. Spring 9 is positioned within pivot bore 31 between support shaft 6 and the bottom side of a step 32 within pivot bore 31. In the illustrated embodiment, spring 9 is in tension, and biases support shaft 6 downward from step 32. In other embodiments, spring 9 may be in compression and may bias support shaft 6 upward. Additionally, spring 9 may be any biasing member, such as an air spring or a resilient material such as an elastomer.

As shown best in FIG. 5, rotary positioning member 5 comprises a number of gear teeth 51 with angled sides 52. The gear teeth 51 are configured to mesh with a number of gear teeth 33 on the top side of step 32. In the position shown in FIG. 4, spring 9 biases support shaft 6 downward, and since rotary positioning member 5 is coupled to support shaft 6, spring 9 also biases rotary positioning member 5 downward. Gear teeth 51 mesh with gear teeth 33 to prevent rotation of rotary positioning member 5 around the axis A1. As will be described in more detail later, locking switch 4 may be activated to raise rotary positioning member 5 upward so that the gear teeth 51 and 33 at least somewhat separate, and rotary positioning member 5 may rotate. The angled sides 52 of gear teeth 51 allow for easier rotation of rotary positioning member 5 along step 32.

Attachment connector 7, support shaft 6, and rotary positioning member 5 are all coupled together to main body 1 so that when main body 1 rotates about the axis A1, attachment connector 7, support shaft 6, and rotary positioning member 5 also rotate. Support shaft 6 and rotary positioning member 5 are configured to rotate within pivot bore 31. Spring 9 may also rotate. Assembly hub 35 is fixedly coupled to mounting structure 2 through front bracket 36 and rear bracket 37, so that when main body 1 rotates, pivot bore 31, assembly hub 35, front bracket 36, rear bracket 37, and groove 34 remain fixed relative to mounting structure 2 (and pool 200). Locking switch 4 may be externally threaded and configured to engage an internally threaded upper end of assembly hub 35 such that, when threaded together, locking switch 4 will remain stationary with assembly hub 35 relative to main body 1.

In the illustrated embodiment, front bracket 36 is an integral part of assembly hub 35, but in other embodiments they may be separate parts coupled together. Front bracket 36 couples to rear bracket 37 through snaps or other coupling features and leaves a gap between them to accommodate groove 34 and slidable connector 10. As shown in FIG. 3, the bottom edges of front bracket 36 and rear bracket 37 are shaped to match the shape of groove 34. Front bracket 36 and rear bracket 37 also comprise a number of holes 38 configured to interact with fasteners 30 (See FIG. 2). In the illustrated embodiment, fasteners 30 are screws or inserts configured to pass through holes 38 to couple attachment assembly 3 to mounting structure 2. As shown in FIG. 2, mounting structure 2 comprises a number of coupling features 21 configured to interact with fasteners 30. In the illustrated embodiment, coupling features 21 are vertical slots configured to receive fasteners 30. In the illustrated embodiment, mounting structure 2 comprises two columns of coupling features 21 and fasteners 30 are adjustable screws, so the height of main body 1 within the pool 200 relative to mounting structure 2 may be adjusted by affixing fasteners 30 along different heights within coupling features 21. In other embodiments, mounting structure 2 may comprise a number of discrete coupling features 21 in different positions along mounting structure 2 in order to mount attachment assembly 3 at various locations relative to mounting structure 2. In still other embodiments, coupling features 21 may be protrusions or detents, and attachment assembly 3 may comprise complimentary features to couple the two together without fasteners 30. Furthermore, attachment assembly 3 may be coupled to mounting structure 2 through adhesives, snaps, rivets, or other coupling features.

The vertical movement of main body 1 relative to mounting structure 2 (and pool 200) may constitute a second degree of freedom.

In an exemplary embodiment, spring 9 is composed of a resilient metal, and each other component of attachment assembly 3 is composed of a polymer. In other embodiments, any of the components of attachment assembly 3, mounting structure 2, or main body 1 of swimming machine 100 may be composed of a polymer, a metal, or a polymer-coated metal. Furthermore, any components of swimming machine 100 may be coated with a material to prevent water, sun, and environmental damage.

Figure 6:
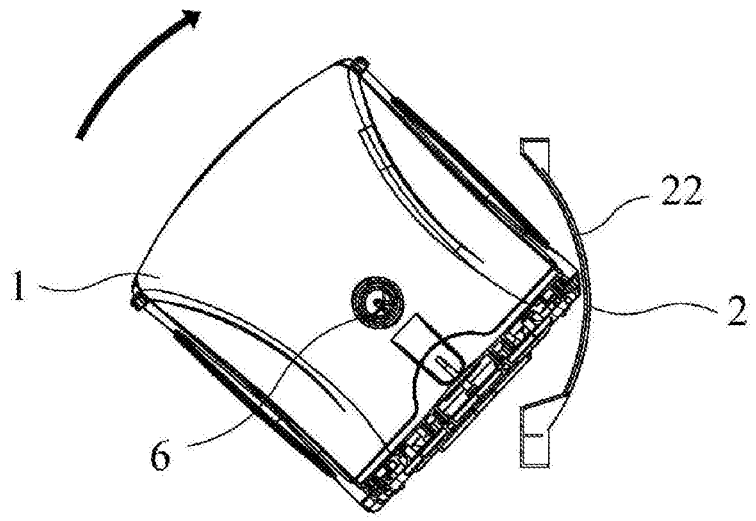
FIG. 6 is a partial, top view of the swimming machine of FIG. 1.
Figure 7:
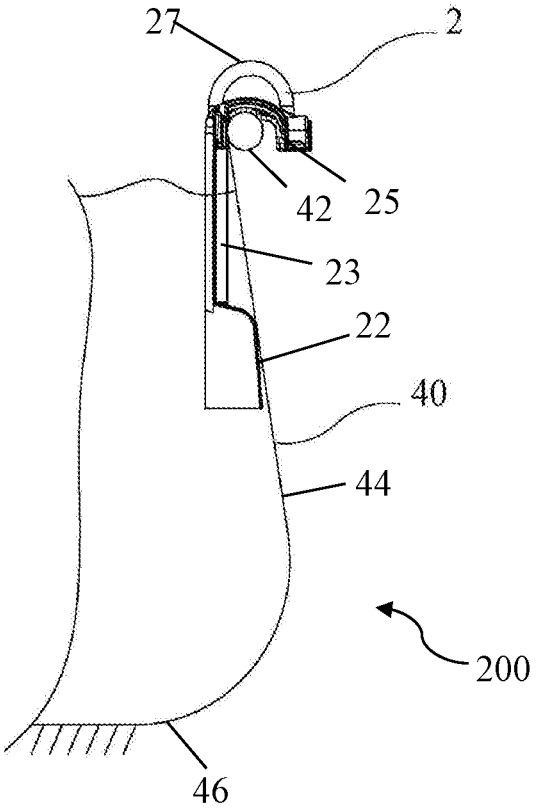
FIG. 7 is a cross-sectional side view of a mounting structure for the swimming machine of FIG. 1 attached to a pool.

Referring now to FIGS. 6-7, swimming machine 100 is configured to be mounted upon frame 42 adjacent to sidewall 44 of pool 200 through mounting structure 2. Mounting structure 2 comprises a mounting base 25, handles 27, and a support wall 23 having a concave portion 22. Mounting base 25 is configured to interact with an upper edge of pool 200, illustratively frame 42 forming the upper edge of pool 200, and to support the weight of swimming machine 100. In the illustrated embodiment, mounting structure 2 is removably couplable from the frame 42, and may be positioned at various points along the frame 42. In this way, the swimming machine 100 may be used with a variety of pools and does not need to be an integral part of the pool 200. Mounting base 25 may be sized to wrap at least partially around frame 42 in a friction-fit manner. Mounting base 25 may also comprise fasteners or additional coupling features to further couple the mounting structure to the frame 42 of the pool 200. The handles 27 extend upwardly from the mounting base 25 are configured to provide a user with a grip on mounting structure 2, and to facilitate moving or adjusting mounting structure 2. The handles 27 may also be configured to provide additional structural support to mounting structure 2. Support wall 23 provides additional support to mounting structure 2 and provides an interfacing surface for attachment assembly 3. Concave portion 22 is configured to receive at least a portion of main body 1. As shown in FIG. 6, when main body 1 rotates, concave portion 22 is sized and shaped to accommodate movement of main body 1. Additionally, in the illustrated pool 200, the sidewall 44 is slightly angled, so concave portion 22 makes use of an area between the support wall 23 and the sidewall 44. In other embodiments without concave portion 22, main body 1 may hang below an extent of support wall 23.

Referring now to FIGS. 8-11, swimming machine 100 is configured to switch from a locked state to an unlocked state, and vice versa. In the locked state, main body 1 is locked into a rotational position and cannot be rotated about axis A1. In the unlocked state, main body 1 is free to rotate about axis A1 in order to direct water in different directions within pool 200.

Figure 8:
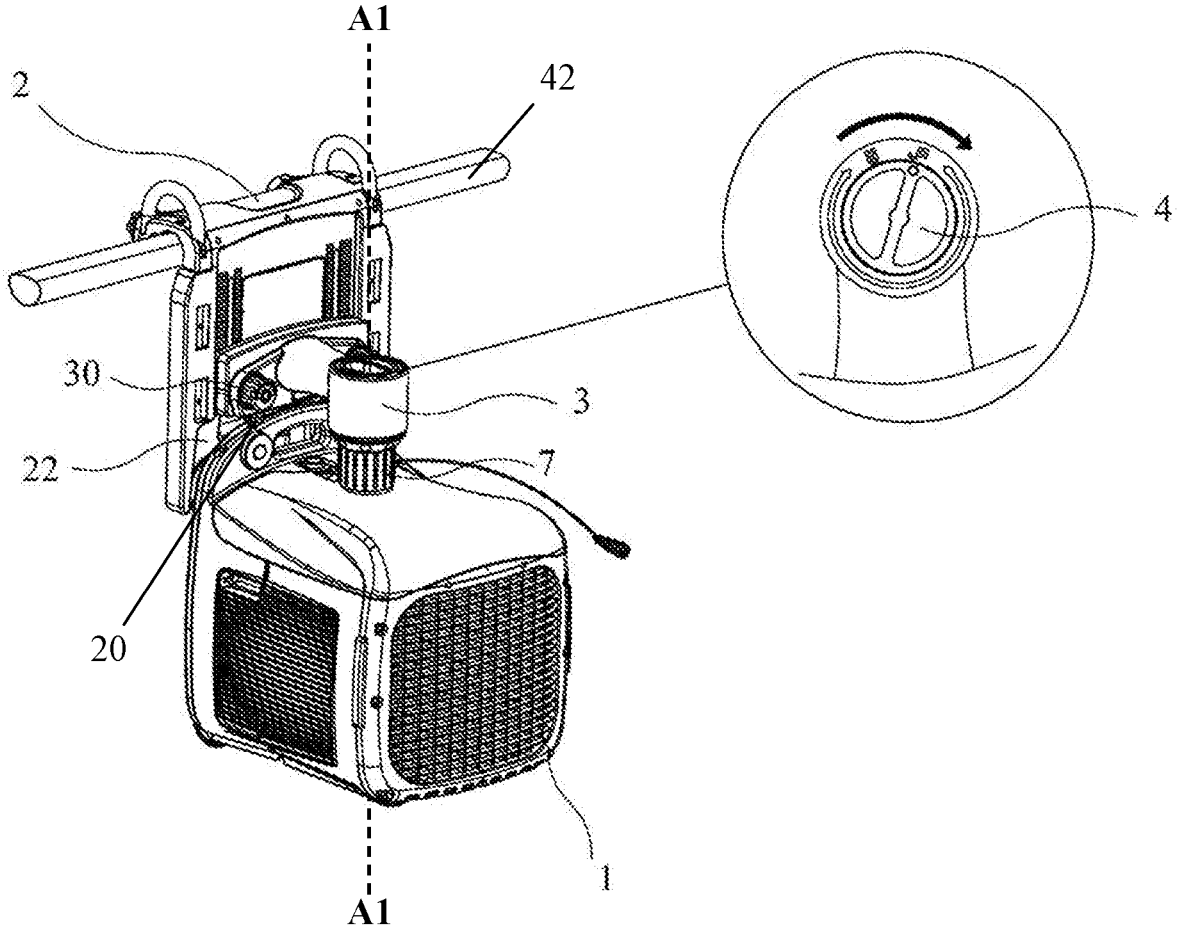
FIG. 8 is a perspective view of the swimming machine of FIG. 1 in an unlocked position.
Figure 9:
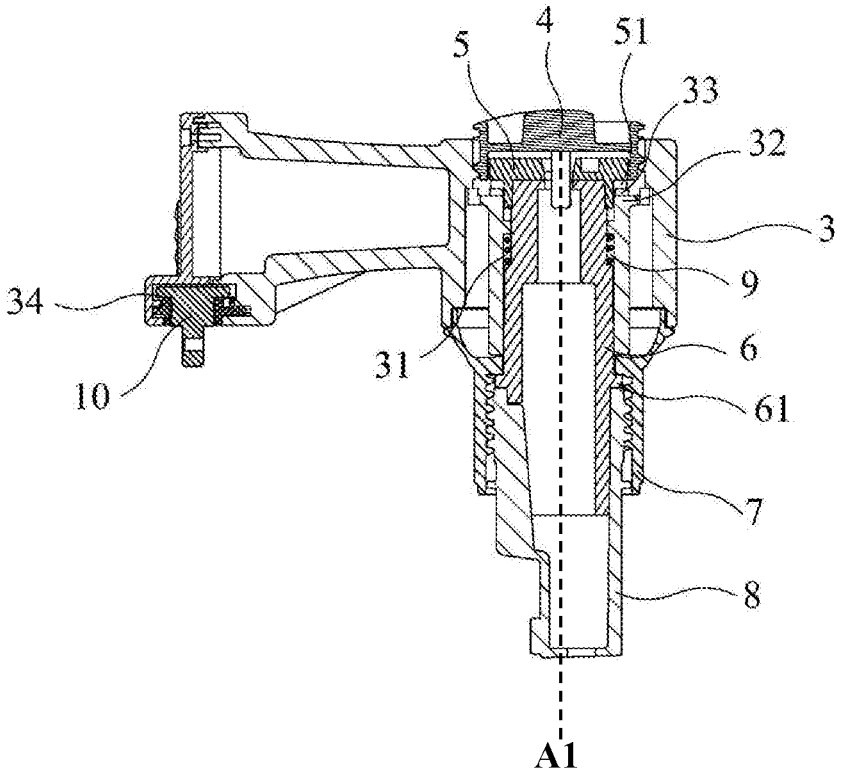
FIG. 9 is a cross sectional view of the attachment assembly of FIG. 3 in an unlocked position.

As shown in FIGS. 8-9, when locking switch 4 is switched to the unlocked state, locking switch 4 is unscrewed in a first direction and moved upward within attachment assembly 3, so that rotary positioning member 5 also moves upward. In embodiments where spring 9 is in compression and biases support shaft 6 upward, spring 9 pushes rotary positioning member 5 upward when locking switch 4 is moved upward. In embodiments where spring 9 is in tension and biases support shaft 6 downward, locking switch 4 may pull up rotary positioning member 5 against the bias of spring 9. When rotary positioning member 5 is moved upward, gear teeth 51 at least partially disengage from gear teeth 33, such that rotary positioning member 5 is then able to rotate about axis A1. The user is then able to rotate the unlocked main body 1 relative to mounting structure 2 (and pool 200). As noted above, slidable connector 10 (FIG. 2) extends upwardly from fixed connector 20 on main body 1 and travels through groove 34 of attachment assembly 3 (FIG. 2) to support and guide such rotation of main body 1.

Figure 10:
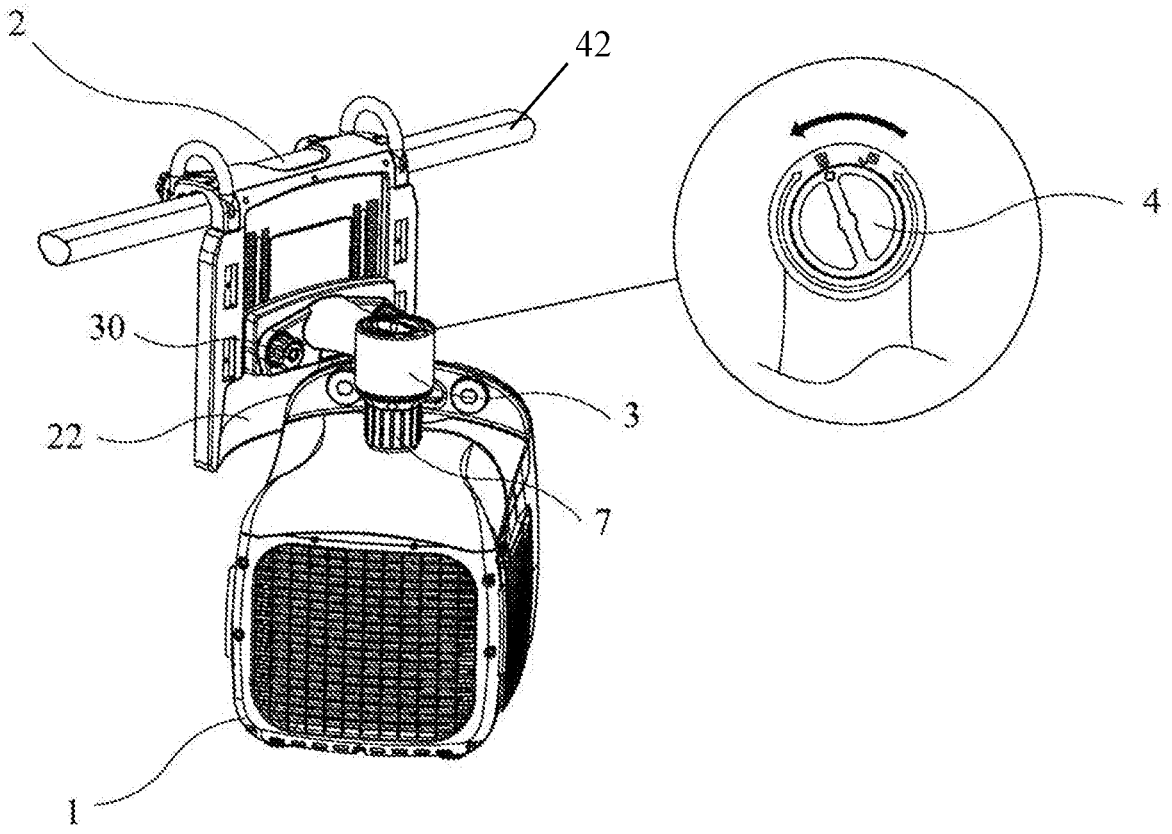
FIG. 10 is a perspective view of the swimming machine of FIG. 1 in a locked position.
Figure 11:
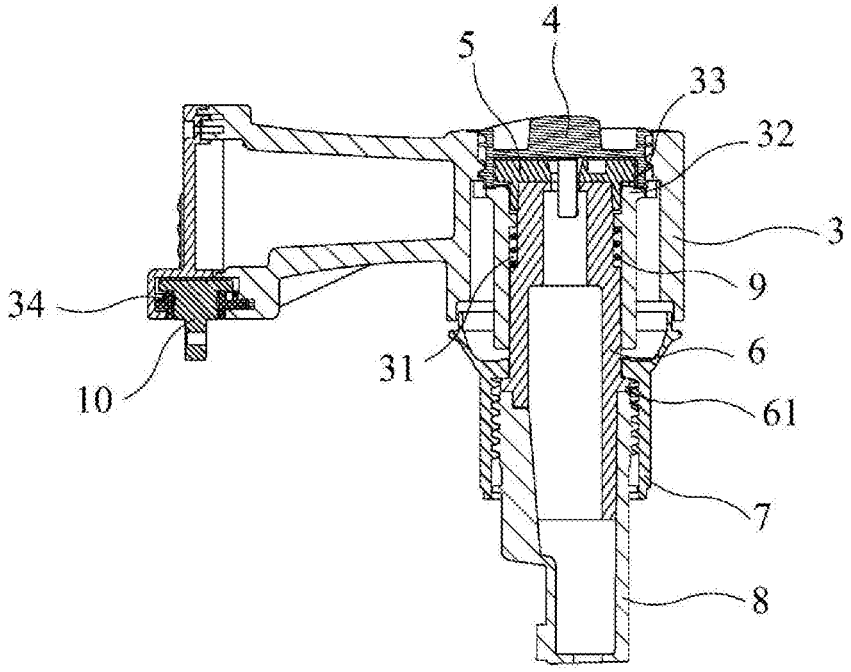
FIG. 11 is a cross sectional view of the attachment assembly of FIG. 3 in a locked position.

As shown in FIGS. 10-11, when locking switch 4 is switched to the locked state, locking switch 4 is screwed in a second direction and moved downward into attachment assembly 3 and pushes rotary positioning member 5 downward, causing gear teeth 51 to engage with gear teeth 33 such that rotary positioning member 5 is rotationally fixed in place. The size and number of gear teeth 51 and gear teeth 33 may be altered to allow for different ranges of rotation, and different divisions of rotational movement. For example, if gear teeth 51 and gear teeth 33 were smaller, there would be more gradations of positions in which main body 1 could be locked.

In the illustrated embodiment, locking switch 4 is a rotatable knob with indicia indicating which positions correspond to a locked position (FIG. 10) and unlocked position (FIG. 8). As noted above, the illustrative locking switch 4 is externally threaded to engage the internally threaded attachment assembly 3, such that rotation of locking switch 4 drives it upwards or downwards, depending on the direction of rotation. In other embodiments, locking switch 4 may be any mechanical or electrical switch configured to engage and disengage gear teeth 51 and gear teeth 33. For example, locking switch 4 may be an electronic system activated by a remote or by a button to raise rotary positioning member 5. In another embodiment, locking switch 4 may be pressable instead of rotatable to allow for locking and unlocking.

Figure 12:
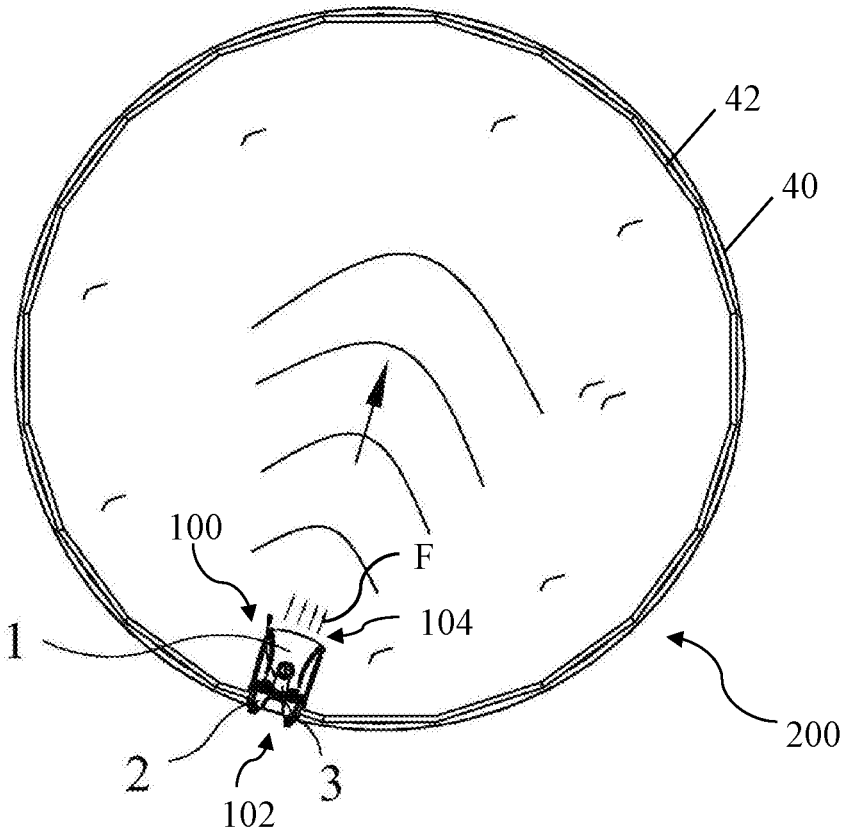
FIGS. 12-14 are top views of the swimming machine of FIG. 1 having different rotary positions and generating a current within various swimming pools.
Figure 13:
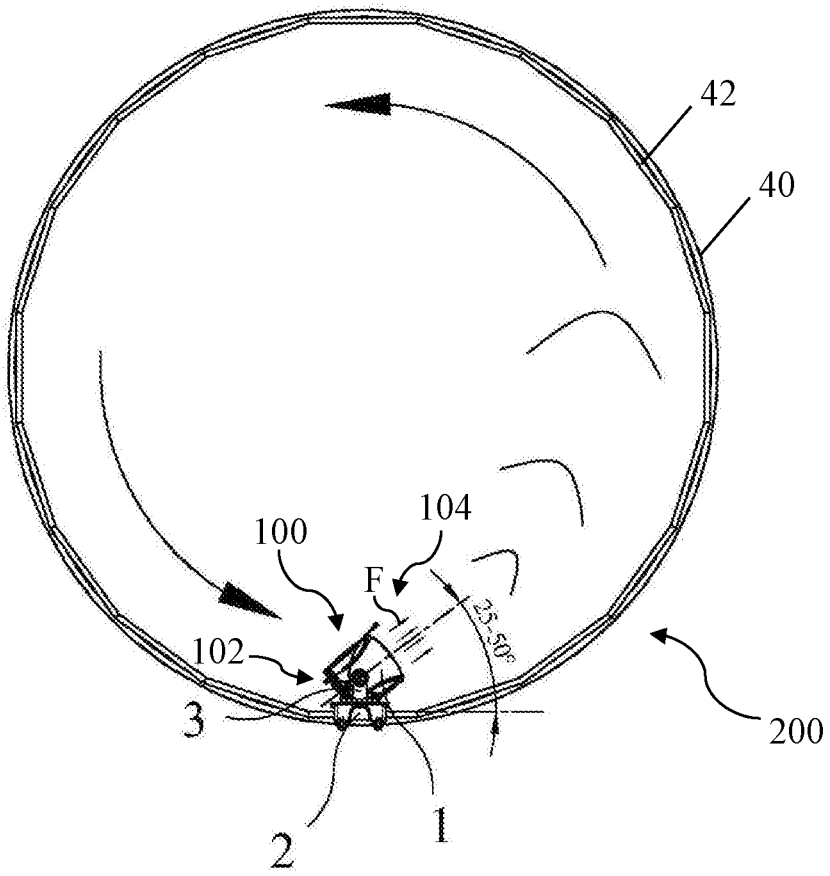
Figure 14:
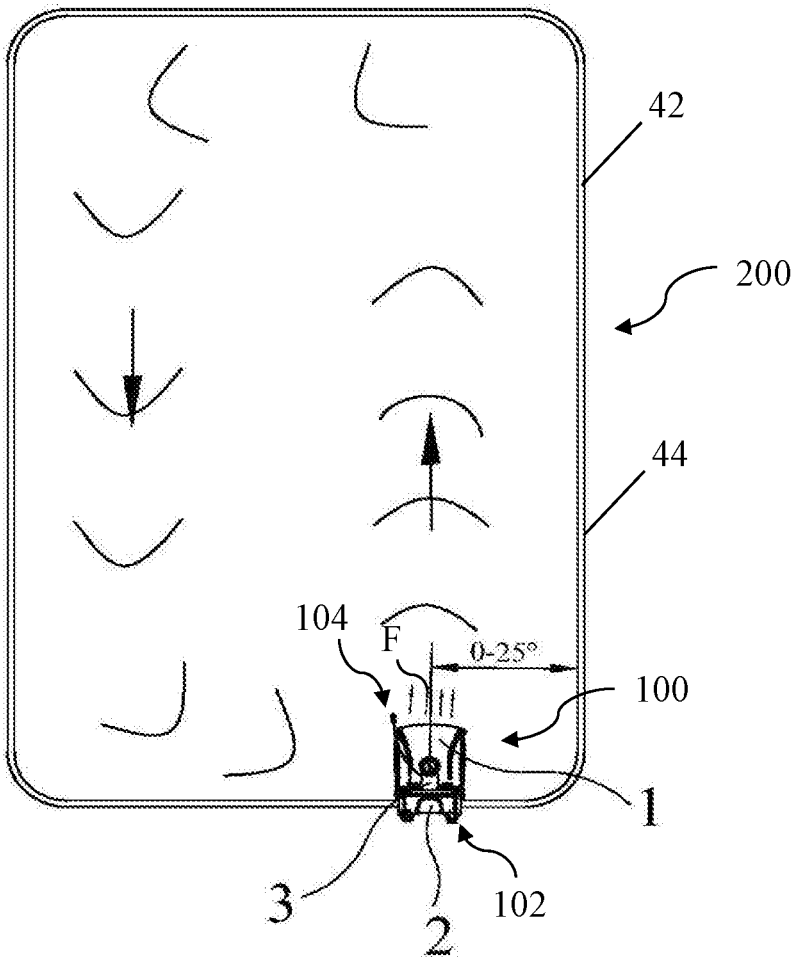

Referring now to FIGS. 12-14, pools 200 of various shapes and sizes are shown with the swimming machine 100 installed and operating. The swimming machine 100 has one or more degrees of freedom relative to each pool 200 such that the swimming machine 100 is configured to generate a desired directional current within each pool 200. As noted above, the current generated is generally directed in the flow direction F, which is generally perpendicular to the inlet side 102 and outlet side 104 of the main body 1. As shown in FIG. 12, swimming machine 100 is positioned with the flow direction F oriented approximately perpendicular to the sidewall 44 of a round pool 200, which generates a current pointed radially towards the center of pool 200. Swimming machine 100 may then be unlocked and rotated to direct the current in a different direction. In certain embodiments, swimming machine 100 may be rotated within a 180° rotational range (i.e., +/−90° from the perpendicular position shown in FIG. 12). In other embodiments, swimming machine 100 may be rotated within a 90° rotational range (i.e., +/−45° from the perpendicular position shown in FIG. 12, or +90° from the perpendicular position shown in FIG. 12). As shown in FIG. 13, for example, to direct the current generally counterclockwise along the wall 40 of the pool 200, swimming machine 100 has been rotated with the flow direction F oriented about 25°-50° away from the sidewall 44. In such a configuration, the swimming machine 100 can create a whirlpool effect within pool 200. As shown in FIG. 14, swimming machine 100 is positioned with the flow direction F generally perpendicular to the short sidewall 44 and generally parallel to the long sidewall 44 of a rectangular pool 200 to achieve a whirlpool effect. As shown in FIG. 14, swimming machine 100 may be rotated to a different position relative to the sidewall 44 (e.g., 0°-25° away from the parallel sidewall 44) to direct flow along the wall 40.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming machine assembly comprising:

a main body configured to generate a current in a pool;

an attachment assembly configured to couple to the main body comprising:

an assembly hub;

a connector configured to couple the main body to the assembly hub;

a rotary positioning member positioned within the assembly hub and configured to position the main body in a number of rotational positions about a vertically extending axis;

a locking switch coupled to the assembly hub and configured to move the rotary positioning member between an unlocked state and a locked state, wherein in the unlocked state the main body is movable between the number of rotational positions about the vertically extending axis; and a mounting structure coupled to the main body through the attachment assembly and configured to be mounted to a pool.

2. The swimming machine assembly of claim 1, wherein the mounting structure is removably couplable from a frame of the pool and may be positioned at various points along the frame.

3. The swimming machine assembly of claim 1, wherein the mounting structure further comprises a recession configured to receive the main body and shaped to accommodate movement of the main body.

4. The swimming machine assembly of claim 1, wherein the locking switch is a rotatable knob configured to move the rotary positioning member between the unlocked state and the locked state through rotation of the knob.

5. The swimming machine assembly of claim 4, wherein rotation of the locking switch moves the locking switch and the rotary positioning member vertically within the attachment assembly.

6. The swimming machine assembly of claim 1, wherein the rotary positioning member comprises a plurality of first gear teeth and the assembly hub comprises a number of second gear teeth configured to interact with the first gear teeth.

7. The swimming machine assembly of claim 6, wherein the first gear teeth mesh with the second gear teeth when the rotary positioning member is in the locked state.

8. The swimming machine assembly of claim 7, wherein the first gear teeth are moved away from the second gear teeth when the rotary positioning member is in the unlocked state.

9. The swimming machine assembly of claim 1, wherein the rotational positions are within 180 degrees or less.

10. The swimming machine assembly of claim 1, wherein the assembly hub is fixedly coupled to the mounting structure, the main body being rotatable relative to the assembly hub and the mounting structure in the unlocked state.

11. A mount for a swimming machine comprising:

a mounting structure configured to removably mount to a frame of a pool;

an attachment assembly coupled to the mounting structure and to the swimming machine, the attachment assembly comprising a support shaft and an assembly hub, the assembly hub fixedly coupled to the mounting structure; and a rotary positioning member coupled to the support shaft and the swimming machine, the rotary positioning member and the support shaft positioned within the assembly hub and rotatable relative to the assembly hub, wherein the swimming machine, the support shaft, and the rotary positioning member rotate together around an axis.

12. The mount of claim 11, wherein the attachment assembly further comprises a locking switch configured to lock and unlock the rotary positioning member, wherein when the rotary positioning member is locked, the rotary positioning member is not rotatable relative to the assembly hub.

13. The mount of claim 12, wherein the rotary positioning member engages with a feature of the assembly hub when locked and at least partially disengages with the feature when unlocked.

14. The mount of claim 11, further comprising a bracket coupling the attachment assembly to the mounting structure and an attachment connector coupling the attachment assembly to the swimming machine.

15. The mount of claim 14, further comprising a movable connector within the bracket coupled to the swimming machine and movable within a groove to accommodate rotation of the swimming machine.

16. The mount of claim 11, wherein the mounting structure further comprises a plurality of coupling features configured to interact with a plurality of fasteners, the fasteners coupling the attachment assembly to the mounting structure.

17. The mount of claim 16, wherein the attachment assembly is positionable at multiple vertical positions on the mounting structure by positioning the fasteners within coupling features at multiple vertical locations within the mounting structure.

18. A method of positioning a swimming machine within a pool comprising the steps of:

coupling the swimming machine to an attachment assembly;

mounting a mounting structure on the pool;

coupling the attachment assembly to the mounting structure through a plurality of fasteners;

unlocking a rotary positioning member within the attachment assembly;

rotating the swimming machine about a vertically extending axis to alter an angular position of the swimming machine relative to a wall of the pool; and locking the rotary positioning member to limit rotation of the swimming machine relative to the wall of the pool.

19. The method of claim 18, further comprising the step of moving the mounting structure to a separate position along the pool.

20. The method of claim 18, wherein the steps of unlocking and locking the rotary positioning member are completed through the rotation of a locking switch.

21. The swimming machine assembly of claim 1, wherein the main body comprises a fixed connector; and wherein the attachment assembly further comprises a slidable connector configured to couple to the fixed connector, the slidable connector and the fixed connector configured to guide the rotational movement of the main body.

22. The swimming machine assembly of claim 1, wherein the mounting structure comprises a recess adapted to receive an upper edge of the pool.

23. The swimming machine assembly of claim 1, wherein the vertically extending axis is substantially perpendicular to the assembly hub.

24. The swimming machine assembly of claim 1, wherein the vertically extending axis is positioned within a central portion of the main body.

25. The method of claim 18, wherein the step of mounting the mounting structure includes the step of receiving an upper edge of the pool within a recess in the mounting structure.

26. The method of claim 18, wherein the step of mounting the mounting structure on the pool includes the steps of receiving an upper edge of the pool within a recess in the mounting structure such that the mounting structure is positioned on both an outer side and an inner side of the pool wall and contacting a side wall of the pool with a mounting base, the mounting base being spaced apart from the recess of the mounting structure.

* * * * *